United States Patent [19]

Nygards

[11] 4,090,450

[45] May 23, 1978

[54] SAFETY DEVICE

[75] Inventor: Olof Martin Nygards, Karlskoga, Sweden

[73] Assignee: Aktiebolaget Bofors, Bofors, Sweden

[21] Appl. No.: 733,987

[22] Filed: Oct. 20, 1976

[30] Foreign Application Priority Data

Nov. 1, 1975 Sweden ..... 7412494

[51] Int. Cl.[2] ..... F42C 15/34

[52] U.S. Cl. ..... 102/76 P; 102/77; 102/79

[58] Field of Search ..... 102/70 R, 76 R, 76 P, 102/77, 79, 85, 72; 89/1 B

[56] References Cited

U.S. PATENT DOCUMENTS

| | | | |
|---|---|---|---|
| 2,737,892 | 3/1956 | Dalton et al. | 102/81 |
| 3,547,033 | 12/1970 | Gawlick et al. | 102/70 R |
| 3,618,523 | 11/1971 | Higuera et al. | 102/76 R X |
| 3,620,164 | 11/1971 | Carroll | 102/79 X |
| 3,744,424 | 7/1973 | Popper et al. | 102/76 P X |
| 3,886,868 | 6/1975 | Webb | 102/79 |
| 3,978,791 | 9/1976 | Lemley et al. | 89/1 B X |

*Primary Examiner*—David H. Brown
*Attorney, Agent, or Firm*—Pollock, Vande Sande & Priddy

[57] ABSTRACT

An improved safety device for a projectile includes a movable element which selectively positions a priming cap in position to ignite the charge of the projectile. A safety plate separating the priming cap and the main charge of the projectile is pierced by a member projected from the safety device by the gas pressure of the ignited priming cap.

10 Claims, 6 Drawing Figures

SAFETY DEVICE

BACKGROUND OF THE INVENTION

The present invention relates to a safety device for an initiating device for a projectile, rocket or the like. The initiating device is located close to the charge in the projectile, and is intended to achieve positive initiation of this charge. It is moreover a requirement that the initiating device must be safe against accidental ignition during the transport and storage of the projectile.

In the prior art, an initiating device contains an initiating unit, particularly in the form of a striker pin, which ignites a priming charge or cap which thereafter ignites the charge in the projectile.

The priming charge typically comprises a detonator which, for safety reasons, can be applied in a movable member which can assume two positions, a first, safety position in which initiation of the charge in the projectile is prevented since the priming charge and the main charge are separated by a barrier, as well as a second, armed position, in which the priming charge can initiate the main charge.

It is previously known to arrange a movable member in the form of a safety rotor which is rotatable around an axis which is parallel to the direction of movement of the projectile. The rotor then assumes a certain angular position in the safe condition and can be turned to another angular position in the armed condition. The detonator is placed in an axial cavity in the rotor, and this cavity, in the armed condition, is aligned with an opening in the barrier so that the hot flame gases formed at the ignition of the detonator can pass through the opening and ignite the charge in the projectile by piercing the safety plate which protects the main charge.

In order to prevent the explosive charge from being set off unintentionally when the initiating device is in the safe condition, e.g. when the projectile is in storage or is being transported, it is desirable to have the barrier between the charged as thick as possible, so that the hot flame gases will not be capable of penetrating it if the detonator, for any reason, should be set off. On the other hand, it is a disadvantage if the charges are placed altogether too far from each other in the armed condition, as it may then happen that the hot flame gases from the detonator will not have sufficient force to penetrate the safety plate which, in itself, is thin. This contradictory condition has had the result that, for safety reasons, it has been necessary to resort to more or less sophisticated safety devices which for instance, utilize the rotation or acceleration of the projectile. A common feature of these devices is, however, that there is a great number of movable parts, which makes the manufacture complicated and makes the device susceptible to damage, and expensive.

OBJECTION AND SUMMARY OF THE INVENTION

The purpose of the present invention is, in a simple way, to solve the above-mentioned problem, and at the same time to provide for reliable functioning of the safety device. The invention is then characterized substantially by a member which is accelerated by the gas pressure generated at the combustion of the priming charge and pierces the safety plate which protects the charge in the projectile.

This gives a more reliable mechanism for breaking through the safety plate in the armed condition, at the same time as a reinforcement of the barrier between the charges is obtained in the safe condition.

BRIEF DESCRIPTION OF THE DRAWINGS

In the following, the invention will be described in more detail, with reference to the accompanying drawings, in which

FIGS. 1 and 2 show an axial section of the part of the initiating device which comprises the safety device. FIG. 1 when shows the initiating device in the safety position and FIG. 2 shows the initiating device in the armed position. The initiating device 1 is located in connection with the charge in a projectile, rocket or the like which is to be ignited. The charge can be, for example, an quantity of easily ignited black powder. The charge is contained in a space 2 in the projectile which is separated from the other parts of the initiating device by a safety plate 3, which forms a gas barrier for the charge. The safety plate is in contact with a sealing ring 4 placed in a circular groove 5 in the cross-section area 6 of the wall 7 which encloses the space 2 for the charge. The safety device of the initiating device comprises a substantially sleeve-shaped safety rotor 8, which is arranged to be turned around a tubular central section 9 of the initiating device. The rotor comprises a wider part 10 which has a through cavity 11 in which an initiating unit in the form of a detonator or primary cap 12 is placed. The detonator 12 is of the kind which does not detonate, but burns and develops hot flame gases which build up a gas pressure in the cavity. The cavity 11 also contains a solid cylindrical member 13 (a punch) placed in the part of the cavity which faces the charge in the projectile. This part of the cavity has a smaller diameter than the rest of the cavity, so that a shoulder is formed, against which the detonator is supported. The member 13 which is pressed into the cavity 11 forms a gas-tight plug in the cavity, and is preferably made of the same material as the other parts of the rotor.

Figure 1:
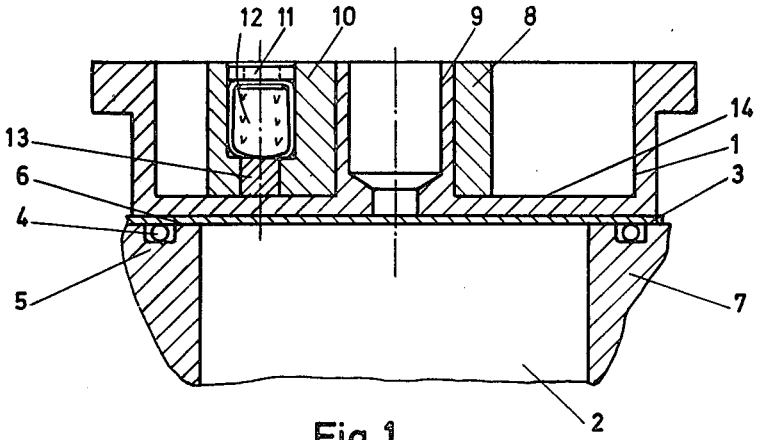
FIG. 1 shows an axial section of an advantageous embodiment of the safety device, comprising a rotor which is in its safety position taken on line "A—A" of FIG. 3.

The part of the charge in the projectile facing the initiating device has a circular, transversal wall 14, which forms a barrier between the detonator and the charge. The transversal wall is in contact with the safety plate 3, and has a sufficient thickness so that it will not give way to the gas pressure in case of accidental ignition of the detonator. The transversal wall is provided with a through hole 15 (see FIG. 2) and in the armed position, the safety rotor is set so that the cavity 11 in the rotor and the hole 15 are aligned see FIG. 2). The diameter of the hole 15 is preferably somewhat larger than the diameter of the cavity, so that the member 13 can pass freely through the transversal wall at the ignition (see below). Further, the cylindrical member has a length which exceeds the thickness of the transversal wall, so that the member reaches the safety plate when the other part of the member is still in the cavity and is being subjected to the full gas pressure. When the safety rotor is in the safe condition, the cavity 11 and the hole 15 are not aligned, see FIG. 1, and the member 13 reinforces the barrier between the charges.

Figure 2:
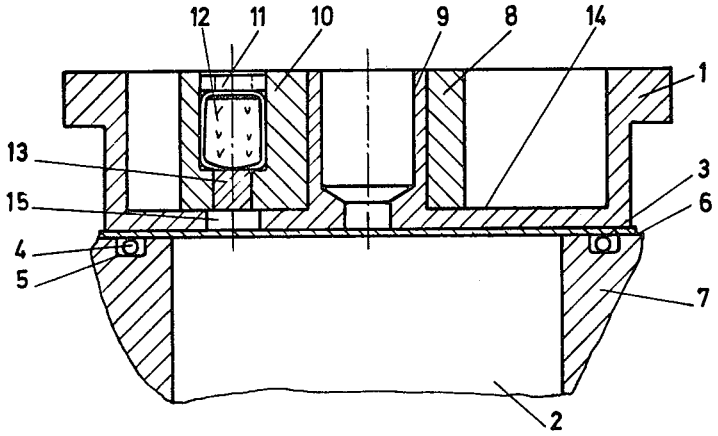
FIG. 2 shows another axial section of the safety device with the rotor in the armed position taken on line "B—B" of FIG. 3.
Figure 3:
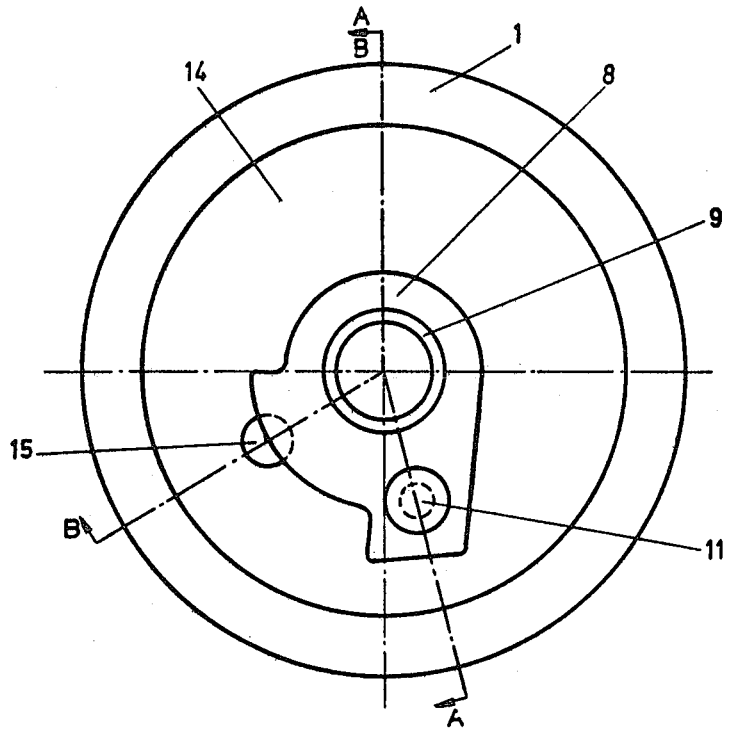
FIG. 3 shows a horizontal view of the safety device.

FIG. 3 shows a horizontal view of the initiating device with the safety rotor 8, the safety rotor then being in the safety position. When the initiating device is armed, the safety rotor is turned by members not shown to its armed position, which corresponds to the position where the cavity in the rotor is in line with the hole 15 in the transversal wall of the initiating device. The sections designated A-A and B-B in the Figure are shown in FIG. 1 and FIG. 2, respectively.

Figure 4:
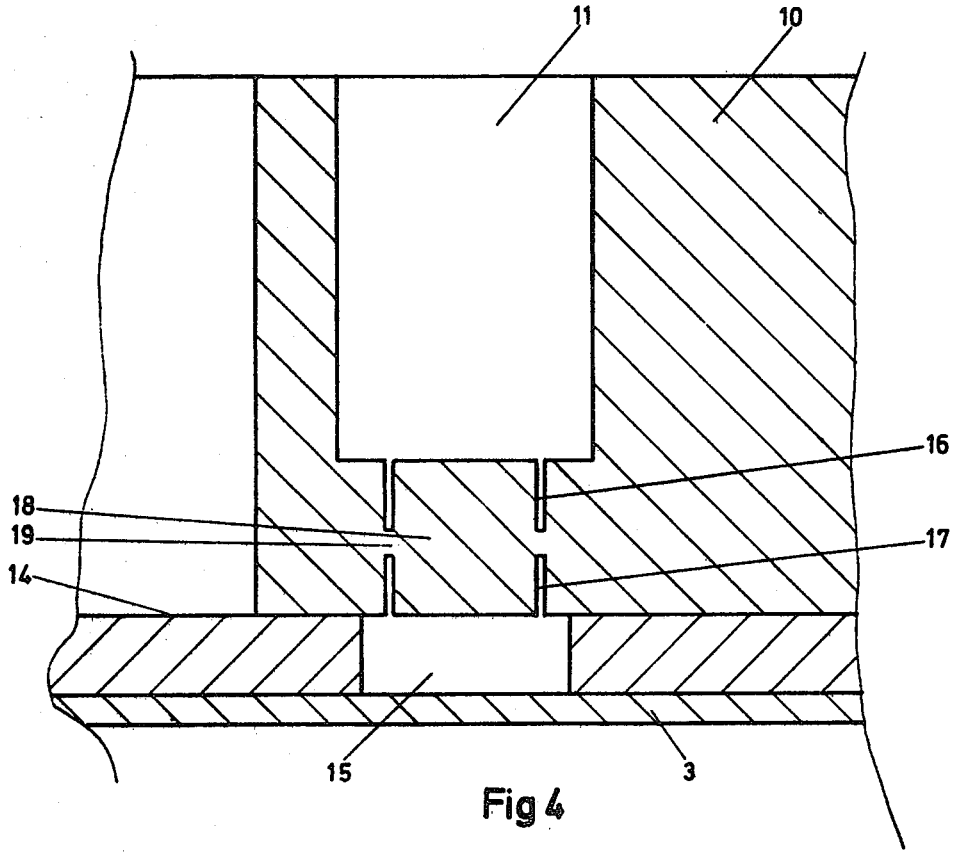
FIG. 4 shows an alternative embodiment of the member actuated by the gas pressure.

The solid, cylindrical member 13 shown in FIGS. 1 and 2 comprises of separate member which is pressed into the cavity 11. However, it is also possible to make the member integrated with the other parts of the rotor. See FIG. 4. Circular recesses 16, 17 are then made in the rotor, so that a substantially cylindrical member 18 is formed, which is connected with the other parts of the rotor by means of a narrow, ring-shaped section 19.

The safety device functions in the following way. When a striker pin (not shown) ignites the detonator 12, hot flame gases are formed, which give rise to a gas pressure which acts upon the walls of the cavity. When the safety rotor is in the safety position (FIG. 1) and cavity 11 and the hole 15 are not aligned, the barrier, consisting of the transversal wall 14 and the member 13 is sufficiently thick to prevent the gas pressure from piercing it in case of accidental ignition of the detonator.

On the other hand, when the safety rotor is in the armed position (FIG. 2) and the cavity 11 and the hole 15 are aligned, the cylindrical member will be accelerated by the gas pressure from the hot flame gases which are formed at the combustion of the detonator. The energy which is stored in the gas pressure is transformed to kinetic energy in the member 13, which moves out of the cavity 11 and through the hole 15 in the transversal wall, and strikes against the safety plate 3. Due to the kinetic energy of the member and the gas pressure which acts upon the end surface of the member, the member will function as a punch, and will punch a hole in the safety plate. The hot flame gases will thereafter have free access to the charge and ignite it. Compared with previously known solutions obtained by allowing the gas pressure to act upon a member 13, a more reliable mechanism for breaking the safety plate will be obtained.

If the member is integrated with the safety rotor (FIG. 4) when the member is actuated by the gas pressure, the ring 18 will serve as a fracture indication, so that the member will be torn loose from the rotor and obtains kinetic energy, and will be capable of breaking through the safety plate 3.

Figure 6:
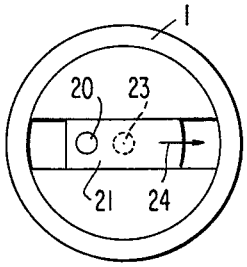
FIG. 6 shows a horizontal view of the safety device of FIG. 5.

In the foregoing, the movable member has been described as being in the form of a rotatable rotor, but it can, however, also consist of a slide which moves transversally in relation to the projectile as shown in FIG. 6 and which comprises an axial cavity in which the detonator and punch are placed (analagous to the positioning in the rotor). The slide then assumes a certain position in the safe condition, and can be displaced to another position in the armed condition. In rotating projectiles this displacement can be achieved for instance through the centrifugal force.

Figure 5:
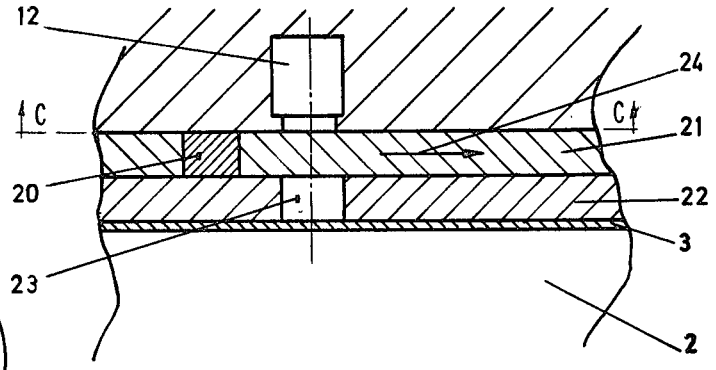
FIG. 5 shows an alternative embodiment of the safety device, comprising a movable slide.

Furthermore, it is not necessary to have both the priming charge and the punch placed in the movable member. FIG. 5 shows an alternative embodiment, in which the detonator is fixed in the initiating device, while the punch 20 is placed in a movable part 21. The safety device moreover comprises a fixed separating wall 22 (a barrier) which is provided with a hole 23 in line with the detonator. In the figure, the safety device is in the safety position, but the movable part 21 can be displaced in the direction of the arrow 24 until the punch is in line with the detonator and the hole 23, and the safety device is then in its armed position. The punch can also be located adjacent to the detonator in the fixed part, i.e. in the cavity between the detonator and the movable part 21, the movable part then being provided with a through hole.

The invention is not limited to the embodiments shown above as examples, but can be subject to modifications within the scope of the accompanying claims. Thus, for instance, it can be an advantage to make the punch pointed, so that it can more easily pierce the safety plate.

I claim:

1. An improved safety device for the initiating device of a projectile, rocket or the like, said projectile being of the type having a space for a charge, said space being closed at one end by a safety plate; a priming charge; and movable member means arranged on the opposite side of said plate from said charge for movement from a safety position in which said priming charge is separated from said safety plate by at least said movable member means to an armed position in which hot gases from said priming charge can pass through said movable member and safety plate to ignite said charge, said safety device further comprising a punch member means mounted for acceleration by gas pressure generated upon ignition of said priming charge for piercing said safety plate to allow said hot gases to reach and ignite said charge.

2. A safety device according to claim 1, wherein said punch member means is integral with said movable member means by means of a narrow, ring-shaped section.

3. A safety device according to claim 1, wherein said movable member means comprises a sliding member mounted for movement transversely of said projectile.

4. A safety device according to claim 1, wherein said priming charge is stationary and said movable member means forms a barrier between said priming charge and said safety plate in said safety position, further comprising a hole in said movable member means which aligns with said priming charge when said movable member means is in said armed position.

5. A safety device according to claim 1, wherein said priming charge is arranged in a cavity in said movable member, means further comprising a barrier between said movable member means and said safety plate, said barrier having an opening which aligns with said priming charge in said armed position.

6. A safety device according to claim 5, wherein said punch member means is arranged in said cavity with said primary charge.

7. A safety device according to claim 6, wherein said movable member means comprises a rotor mounted for rotation about an axis in said projectile between said safety and armed position.

8. A safety device according to claim 7, wherein said axis is parallel to the axis of said projectile and said cavity forms a through hole in said rotor, said hole being parallel to said axis.

9. A safety device according to claim 8, wherein said cavity is circular; and said punch member means is cylindrical and forms a gas tight seal with the wall of said cavity.

10. A safety device according to claim 9, wherein said punch member means has a length greater than the thickness of said barrier.

* * * * *

UNITED STATES PATENT AND TRADEMARK OFFICE

CERTIFICATE OF CORRECTION

PATENT NO. : 4,090,450

DATED : May 23, 1978

INVENTOR(S) : Olof Martin Nygards

It is certified that error appears in the above-identified patent and that said Letters Patent are hereby corrected as shown below:

The Foreign Application Priority Data should read

-- Nov. 7, 1975 Sweden 75 12494 --.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*